United States Patent [19]

Rudolf et al.

[11] Patent Number: 4,784,062

[45] Date of Patent: Nov. 15, 1988

[54] FUZE FOR A PROJECTILE-FORMING CHARGE

[75] Inventors: Karl Rudolf, Schrobenhausen; Klaus Lindstadt, Schwaig, both of Fed. Rep. of Germany

[73] Assignee: Diehl GmbH & Co., Nuremberg, Fed. Rep. of Germany

[21] Appl. No.: 70,939

[22] Filed: Jul. 8, 1987

[30] Foreign Application Priority Data

Jul. 31, 1986 [DE] Fed. Rep. of Germany ..... 3625967

[51] Int. Cl.[4] ..... F42B 13/10

[52] U.S. Cl. ..... 102/476; 102/265; 102/254; 102/306

[58] Field of Search ..... 102/265, 270, 305–310, 102/475, 476, 501, 235, 244, 251, 254

[56] References Cited

U.S. PATENT DOCUMENTS

| | | | |
|---|---|---|---|
| 3,896,731 | 7/1975 | Kilmer | 102/305 |
| 4,592,281 | 6/1986 | Nagennast | 102/254 |
| 4,662,278 | 3/1985 | Lillios | 102/254 |
| 4,711,181 | 12/1987 | Ringel et al. | 102/476 |

FOREIGN PATENT DOCUMENTS

| | | | |
|---|---|---|---|
| 2170888 | 8/1986 | United Kingdom | 102/476 |

*Primary Examiner*—Harold J. Tudor

*Attorney, Agent, or Firm*—Scully, Scott, Murphy & Presser

[57] ABSTRACT

A fuze for a projectile-forming or fragment-forming, in essence, a spine or barb-forming charge, which affords that two detonating locations which are necessary for the splinter or fragment formation, are concurrently triggered in the region of the circumference of the charge. Through-extending bores are provided in a cover plate for the charge at the end facing towards the fuze, the bores containing a centrally located booster or intensifying charge, and spatially separated therefrom at lateral secure distances, two further booster or intensifying charges positioned diametrically opposite each other, whereby the further booster charges are interconnected through a rapidly reacting transmitting charge arranged in a V-shaped triggering passageway, two detonators being arranged in a slider at a distance from each other, and the detonators in the armed position, respectively, correlate with the central booster charge and with the detonating location for the transmitting charge.

6 Claims, 1 Drawing Sheet

FUZE FOR A PROJECTILE-FORMING CHARGE

BACKGROUND OF THE INVENTION

1. Field of the Invention

The present invention relates to a fuze for a projectile-forming charge or for a barb-forming hollow charge.

2. Discussion of the Prior Art

For a charge, through the intermediary of which there can be produced either an armor-rupturing projectile or a plurality of splinters or fragments, there is required a central or axial detonating location for the formation of the projectile; and two detonating locations which are arranged diametrically opposite each other in the region of the circumference of the explosive charge to provide for the formation of splinters or fragments.

SUMMARY OF THE INVENTION

Accordingly, it is an object of the present invention to propose a simple fuze for a projectile-forming or fragment-forming, in essence, a spine or barb-forming charge, which affords that the two detonating locations which are necessary for the splinter or fragment formation, are concurrently triggered in the region of the circumference of the charge.

The foregoing object is attained, in accordance with the present invention, in that through-extending bores are provided in a cover plate for the charge at the end facing towards the fuze, the bores containing a centrally located booster or intensifying charge, and spatially separated therefrom at secure lateral distances, with two further booster or intensifying charges being positioned diametrically opposite each other, whereby the further booster charges are interconnected through a rapidly reacting transmitting charge which is arranged in a V-shaped triggering passageway, two detonators being arranged in a slider at a distance from each other, and wherein the detonators in the armed position, respectively, correlate with the central booster charge and with the detonating location for the transmitting charge.

Pursuant to the invention it is possible to attain the selection of the detonating locations within the microseconds range; in effect, almost without any delay. As a result thereof, the inventive fuze is adapted for various types of ammunition for which there is contemplated an alternative action, and wherein there must be met with the shortest time the selection for the specialized ammunition action. An article of ammunition of that type is a sensor-triggered projectile charge which, as a rule, does not possess any prior knowledge with respect to the type of the target which is to be attacked, and after acquisition of the target, within microseconds must there be made a decision as to the type of attack.

When the operating crew or the acquisition sensor on the airborne body of a drone, a stand-off carrier, or the ammunition recognizes that the foregoing relates to lightly-armored targets, the detonator which is required for the formation of the splinters or fragments is triggered. The triggering conduit then initiates the simultaneous triggering of the two booster charges which are arranged in the region of the circumference of the charge. On the other hand, for a heavily-armored target, such as a battle tank, there is implemented the triggering of the detonator which is of relevance to the projectile-forming charge.

BRIEF DESCRIPTION OF THE DRAWINGS

Reference may now be had to the following detailed description of an exemplary embodiment of the invention, taken in conjunction with the accompanying drawings; in which.

DETAILED DESCRIPTION

Figure 1:
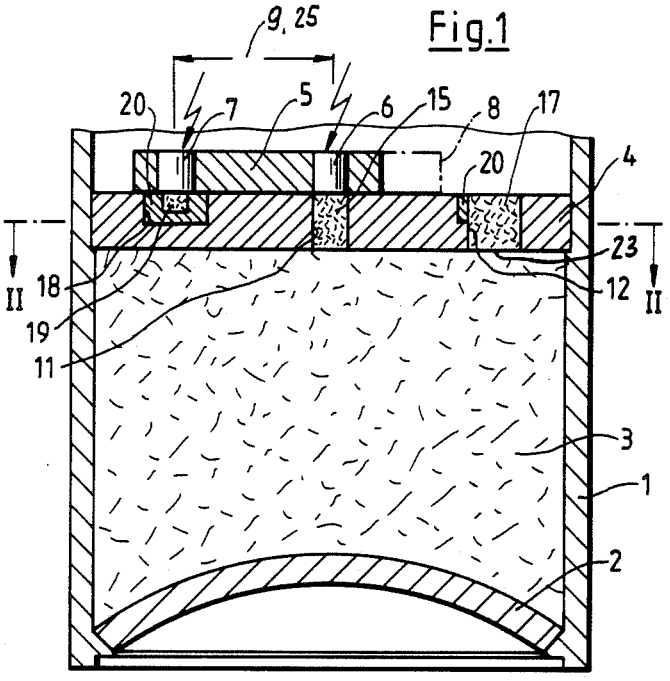
FIG. 1 illustrates a longitudinal sectional view through a projectile-forming hollow charge.
Figure 2:
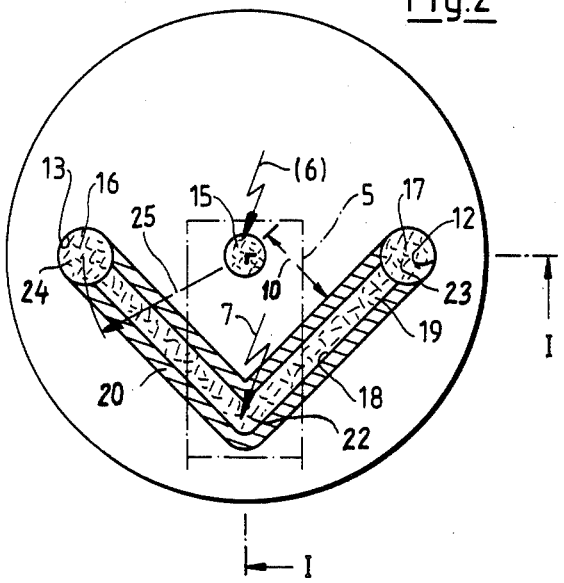
FIG. 2 illustrates a sectional view taken along line II—II in FIG. 1.

Arranged within a casing 1 is a projectile-forming insert 2, an explosive charge 3, a cover plate 4 and a slider 5 with two electrically-triggerable detonators 6, 7 spaced apart a distance 9; in effect, in a radius 25.

In the cover plate 4 there are provided bores 11 through 13 having booster charges 15 through 17 arranged therein, and a V-shaped triggering passageway 18 which is at a secure lateral or sideways distance 10 from the booster charge 15, and which has a rapidly reacting transmitting charge 19 therein, such as an explosive. The triggering passageway 18 is worked into the cover plate 4 and is equipped with a lining 20 of a shockwave-attenuating, porous plastic, such as polytetrafluoroethylene, or constituted of porous metal or a steel wool padding. In consequence thereof, the triggering passageway 18 is constructed such that, on the one hand, there is afforded the through-extending triggering, while, on the other hand, the impact or shock energy is reduced to such an extent within the triggering conduit which is constituted of the plastic material such that there is carried out neither the premature triggering of the central booster charge nor that of the explosive charge 3 which is located beneath the triggering passageway. It is only in the armed position that the slider 5 will assume the illustrated position. Otherwise, the slider 5 is in the secured position of an ineffective position 8, as shown in FIG. 1 by the phantom lines.

For a heavily-armored target, the electrically-activated detonator 6 triggers the booster charge 15, and the latter detonates the explosive charge 3. The latter then forms, in a known manner, an armor-rupturing projectile from the insert 2.

For a lightly-armored target, the electrically-actuated detonator 7 triggers the transmitting charge 19, and the latter triggers the explosive charge 3 through the bores 12 and 13 for the known deformation of the insert 2 into penetration-relevant splinters or fragments. The mutually oppositely located triggering locations 23 and 24 produce overlapping shock waves in the explosive and thereby, on the insert 2, extensively differing energy conversion potentials for each unit of surface and velocity vectors. As a result thereof, there are produced splinters or fragments.

What is claimed is:

1. A fuze for a projectile-forming charge or for a barb-forming hollow charge; comprising a casing housing said hollow charge; a cover plate on said charge on the end of the casing facing towards the fuze; through-extending bores in said cover plate; a centrally arranged booster charge and spatially separated therefrom at secure lateral distances, two additional diametrically oppositely located booster charges, said centrally arranged booster charge and said additional booster charges being located in said through-extending bores; a V-shaped triggering passageway in said cover plate, said additional booster charges being operatively interconnected by a rapidly reacting transmitting charge arranged in said passageway; a slider being displaceable along the surface of said cover plate facing towards the fuze; two detonators arranged in said slider at a spacing from each other, the detonators in an armed position of the slider being selectively alignable with the central booster charge and with a triggering location on the transmitting charge.

2. A fuze as claimed in claim 1, wherein a coating of a shock wave-attenuating material is arranged in the triggering passageway.

3. A fuze as claimed in claim 1, wherein in the armed position of the slider, extending from the central booster charge with the detonator, the further booster charges, the detonators and the triggering location are arranged along a common radius.

4. A fuze as claimed in claim 2, wherein said coating material comprises tetrafluoroethylene.

5. A fuze as claimed in claim 2, wherein said coating material comprises a porous metal.

6. A fuze as claimed in claim 2, wherein said coating material comprises a steel wool padding.

* * * * *